United States Patent [19]

Pfeiffer

[11] Patent Number: 4,852,371

[45] Date of Patent: Aug. 1, 1989

[54] LOCKABLE PORTABLE CONTAINER, ESPECIALLY SUITCASE, BOARD CASE, FILE CASE, FILE CASE OR THE LIKE

[75] Inventor: Michael Pfeiffer, Ismaning, Fed. Rep. of Germany

[73] Assignee: Michael Pfeiffer Design und Marketing GmbH, Ismaning, Fed. Rep. of Germany

[21] Appl. No.: 162,648

[22] Filed: Mar. 1, 1988

[30] Foreign Application Priority Data

Mar. 2, 1987 [DE] Fed. Rep. of Germany ..... 3706723

[51] Int. Cl.[4] ..... E05B 65/52

[52] U.S. Cl. ..... 70/70; 70/210; 70/213

[58] Field of Search ..... 70/67, 69, 70, 71, 72, 70/73, 74, 75, 76, 213, 207, 209, 210, 211

[56] References Cited

U.S. PATENT DOCUMENTS 1,827,060 10/1931 Albert ..... 70/72
2,222,040 11/1940 Miller ..... 70/213

FOREIGN PATENT DOCUMENTS 2037868 7/1980 United Kingdom ..... 70/213

*Primary Examiner*—Robert L. Wolfe
*Attorney, Agent, or Firm*—Barnes & Thornburg

[57] ABSTRACT

This invention provides a lockable portable container, especially a suitcase, a board case, a file case or the like, having a grip movably attached thereto, which is characterized by a coupling means converting the grip movement into a release and/or opening movement of the container locking mechanism, which means is provided as a connection between the grip and the container locking mechanism, as well as by a release blocking and/or opening blocking device arresting the grip movement or neutralizing its transfer to the container locking mechanism.

20 Claims, 1 Drawing Sheet

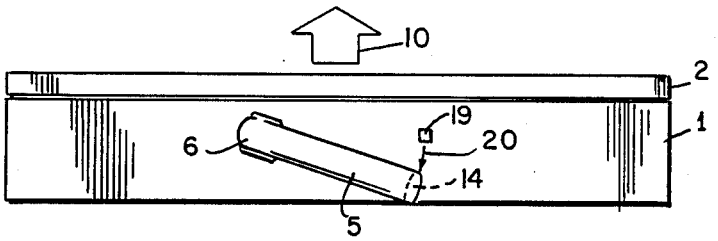
FIG. 4
FIG. 5
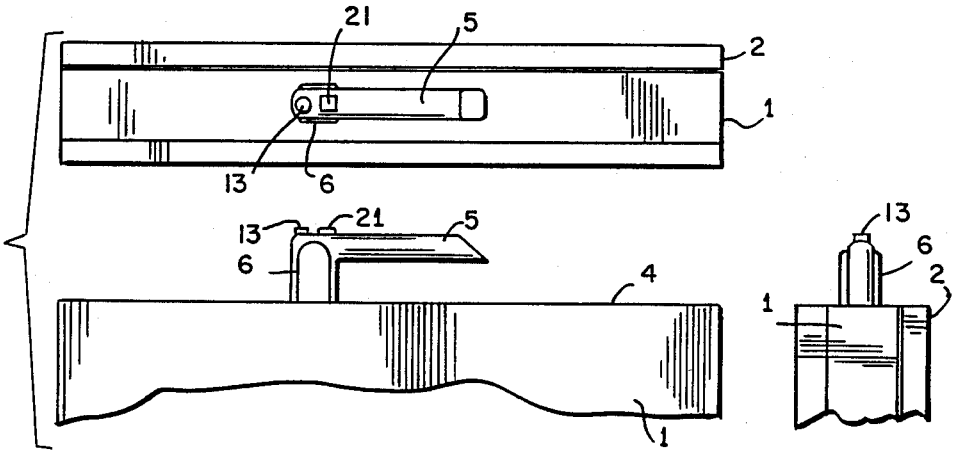
FIG. 6
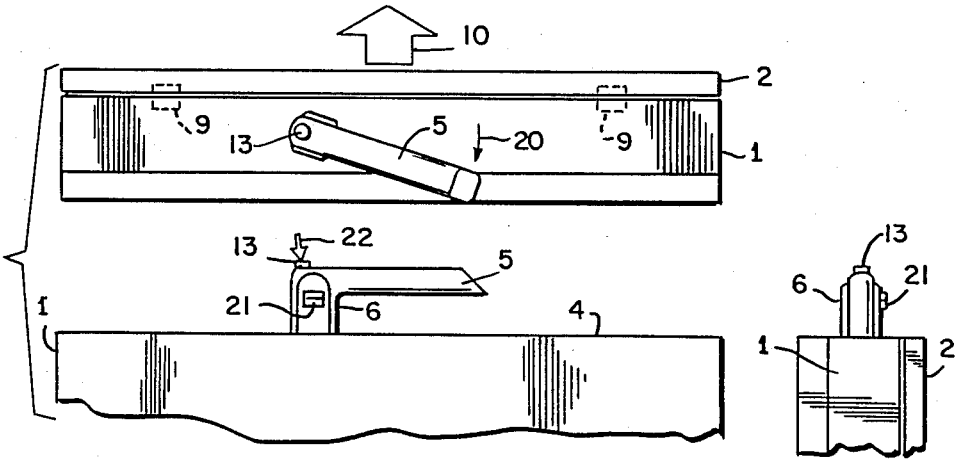

LOCKABLE PORTABLE CONTAINER, ESPECIALLY SUITCASE, BOARD CASE, FILE CASE, FILE CASE OR THE LIKE

This invention relates to a lockable portable container, especially a suitcase, a board case, a file case or the like, having a grip movably attached thereto.

Many lockable portable containers, especially suitcases, board cases, file cases or the like, have been known from prior art, which have a grip movably attached thereto. In this connection the movable attachment of the grip serves to facilitate the user's gripping, carrying, putting down and stowing the portable container, for example a suitcase, and, when transporting portable containers, especially suitcases, also render possible easy and cramped piling up thereof.

In contrast thereto, the present invention especially solves the object to provide a lockable portable container of the above-mentioned type, which can be opened and closed by its user in a particularly practical and comfortable manner.

According to the invention, the object is solved by a coupling means converting the grip movement into a release and lock movement, respectively, and/or opening and closing movement, respectively, of the container locking mechanism, which means is provided as a connection between the grip and the container locking mechanism, and by a release blocking and/or opening blocking device arresting the grip movement or neutralizing its transfer to the container locking mechanism.

In this way it is rendered possible by the invention that the user who, in the case of lockable portable containers, such as for example suitcases, board cases, file cases or the like, usually had to unlock and open or lock two case locks up to now, has now to only move the grip of this portable container in the correspondingly designated manner each after he has actuated a release blocking and/or opening blocking device which is preferred to be directly provided at the grip for practical reasons, so that thereby the container locking mechanism, for example one or two case locks, opens, preferably flies open and, as a result, he only has to raise the top cover of the portable container unless it is provided with an elastic opening means causing the top cover of the portable container to open automatically.

The grip of the portable container according to the invention can be movable in the most different ways, for example the crosspiece of a U-shaped grip whose two legs are attached to the portable container can be developed slidably towards the container and/or away from the container, or this crosspiece can be slidably attached in parallel to the container side at which the grip is mounted, together with the legs.

However, a particularly practical and structurally advantageous embodiment of the lockable portable container according to the invention is obtained when the grip is pivotally mounted to the container and the pivotal mechanism is connected with the container locking mechanism for actuation thereof via the coupling means.

In this case, the development of the lockable portable container can be particularly such that the grip has at least two legs and is pivotally mounted to the container with one leg thereof. Preferably, the grip is mounted to the container pivotally around the longitudinal axis of one leg.

A particularly practical and advantageously to handle embodiment according to the invention results when the grip is L-shaped or U-shaped and mounted to the container pivotally around the longitudinal axis of one of the L-legs or U-legs. This longitudinal axis of the leg, around which the grip is pivotally mounted to the container, is preferred to extend vertically to that container side to which the grip is attached. In this way, the other L-leg or the crosspiece of a U-shaped grip is then pivotal in a practical manner parallel to that side of the container at which the grip is mounted.

When a U-shaped grip is attached to the container as outlined above, it can further be provided at the container in such a way that the U-shaped grip is latchable or arrestable at the container via the other U-leg extending in parallel to the U-leg pivotally mounted to the container, by means of a latching or arresting mechanism, so as to prevent undesired pivotal movement of the grip when carrying the container in a usual way.

It is also possible to develop the lockable portable container according to the invention in such a way that the free end of the other U-leg of the U-shaped grip, which is in parallel to the U-leg pivotally mounted to the container, is guided in a guide being at the container, for example in a guide groove or gap serving as an abutment, which is preferred to have one or two stops limiting the pivotal movement in one pivotal direction or in both pivotal directions, thereby preventing for example an undesiredly wide and unpractical pivoting of the grip.

The release blocking and/or opening blocking device can be developed as a detachable movement lock for the grip thereby securing the grip against pivotal movement when the latter is pivotally mounted to the container.

The above-mentioned latching or arresting mechanism may serve as an embodiment of such a movement lock, however it is particularly preferred to provide such a movement or pivotal lock, respectively, in the movement or pivotal mechanism of the grip, so that the movement lock is integrated in the overall design particularly well.

This movement lock can be released and unlocked, respectively, by means of an actuation element, where the actuation element can be provided at or in the grip or arranged at or in the latching or arresting mechanism.

It is preferred to develop the lockable portable container according to the invention in such a way that the actuation element comprises or is a press button and/or a lock, especially a cylinder or combination lock. In an embodiment of the invention to be particularly preferred in practice, the actuation element is a press button arrestable by the lock, especially the cylinder or combination lock, which can be effected for example in a simple manner in that the locking element actuated by the cylinder or combination lock protrudes into the slide path of the latter as a slide lock when the cylinder or combination lock is not opened and is moved out of this slide path by opening the slide lock.

A particularly compact and highly integrated design is achieved in that the cylinder or combination lock and/or the press button is provided at or in the grip. In the case of the above-mentioned latching or arresting mechanism the cylinder or combination lock and/or the press button can also be mounted at or in the latching or arresting mechanism. However, it is to be referred to the fact that the latching or arresting mechanism mentioned can also be provided only as an auxiliary mechanism to move and/or pivot the grip into the locking position in which it is completely arrested against movement or pivoting by a detachable movement lock provided in the grip itself or in its movement or pivotal mechanism, respectively.

A particularly advantageous embodiment of the release blocking and/or opening blocking device is characterized in that the press button is provided at a pivotally supported lever arm whose pivotal movement is arrestable by the cylinder or combination lock and which acts upon a locking pin cooperating with a locking and guide means mounted at the container, especially with a guide and support plate.

It is preferred to develop the coupling means such that it comprises a bolt unpivotally mounted to the grip and actuation elements movable by the rotation thereof, especially slidable sliding bars for actuating the container locking mechanism.

Finally, a preferred embodiment of the container locking mechanism is characterized in that it has a slide plate slidable by the coupling means, which cooperates with an ejector pivotal around an axis stationary with respect to the container and exposed to a compression spring in the sense of pushing away a hook mounted to the top cover from the container, a locking projection being provided for the hook at the slide plate and the latter in addition having a release projection for the ejector, which secures the ejector in the locking position of the container locking mechanism against pivotal movement and the slide plate in the release position of the container locking mechanism against sliding into the locking position.

The above-mentioned as well as further advantages and features of the invention are detailed hereinafter by means of some particularly preferred embodiments of the invention illustrated in FIGS. 1 to 12 of the drawing:

FIG. 4 shows a view of the lockable portable container of FIG. 3 from above, the grip being pivoted out of the arrested position for opening the portable container;

FIG. 5 shows a fourth embodiment of a lockable portable container according to the invention in a side view and front view as well as in a view from above, the grip of the container being in the locking position;

FIG. 6 shows a fifth embodiment of a lockable portable container according to the invention in a side view and front view as well as in a view from above, the grip being unlocked and pivoted for opening the container;

Figure 7:
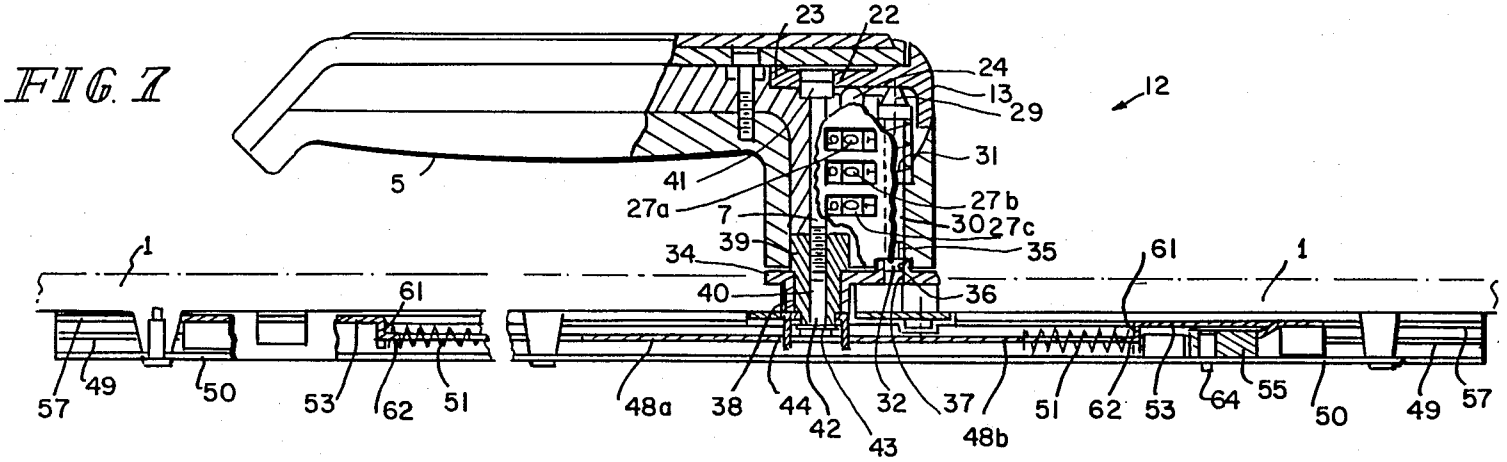
FIG. 7 shows a linear section along line A—A of FIG. 8, which illustrates a release blocking and/or opening blocking device provided inside the grip and the longitudinal narrow side of the container opposite the hinge as well as of part of a coupling means connected thereto.
Figure 8:
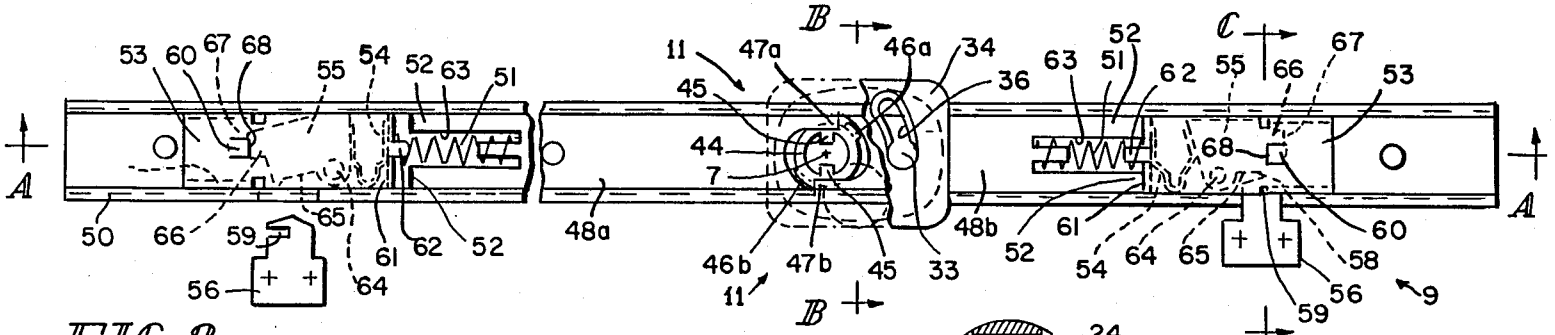
Figure 7A:
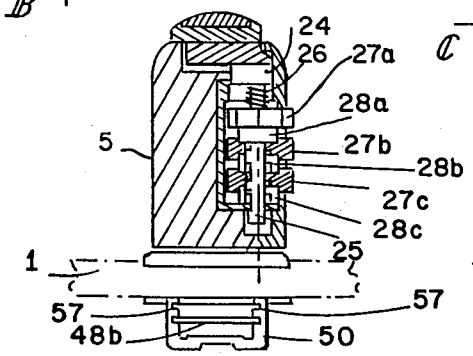
Figure 8A:
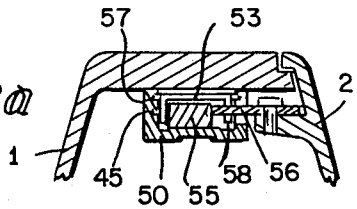
Figure 9A:
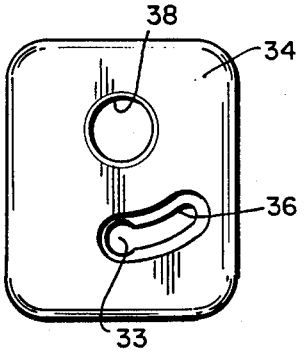
Figure 9:
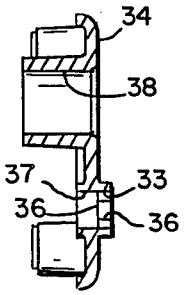
Figure 9B:
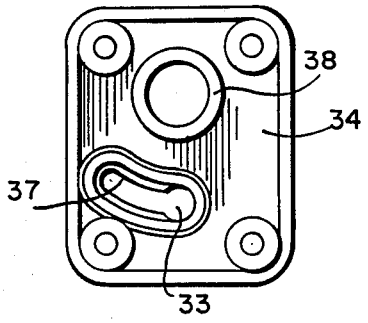
Figure 12:
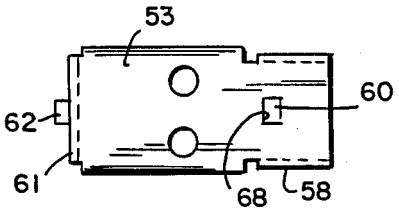
Figure 12B:
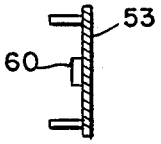
Figure 12A:
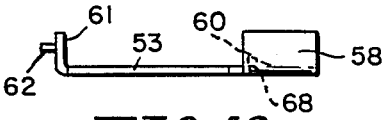
Figure 10:
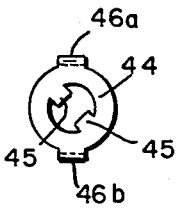
Figure 10A:
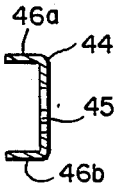
Figure 11:
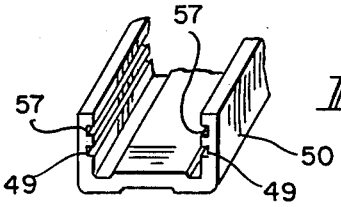

FIG. 7*a* shows a section along line B—B of FIG. 8;

FIG. 8 shows a top view onto the coupling means provided in the longitudinal narrow side opposite the hinge and onto the container locking mechanism also provided therein including the hook provided in the top cover and forming part of the container locking mechanism, in a top view;

FIG. 8*a* shows a section along line C—C of FIG. 8;

FIG. 9 shows the guide and support plate illustrated in FIGS. 7 and 8 in a section;

FIG. 9*b* shows the support plate of FIG. 9 in a top view from above;

FIG. 10 shows the support plate for FIG. 9 in a top view from below;

FIG. 10 shows the bolt illustrated in FIGS. 7 and 8 in a top view;

FIG. 10*a* shows a section of the bolt;

FIG. 11 shows the assembly guide bar onto which the construction of FIG. 8 is substantially mounted;

FIG. 12 the slide plate of the container locking mechanism shown in FIG. 8 in a top view;

FIG. 12*a* shows the slide plate of FIG. 12 in a longitudinal section and FIG. 12*b* shows the slide plate of FIG. 12 in a cross-section.

The figures of the drawing are now dealt with in detail. The same parts of the different figures are provided with the same reference numbers.

Figure 1:
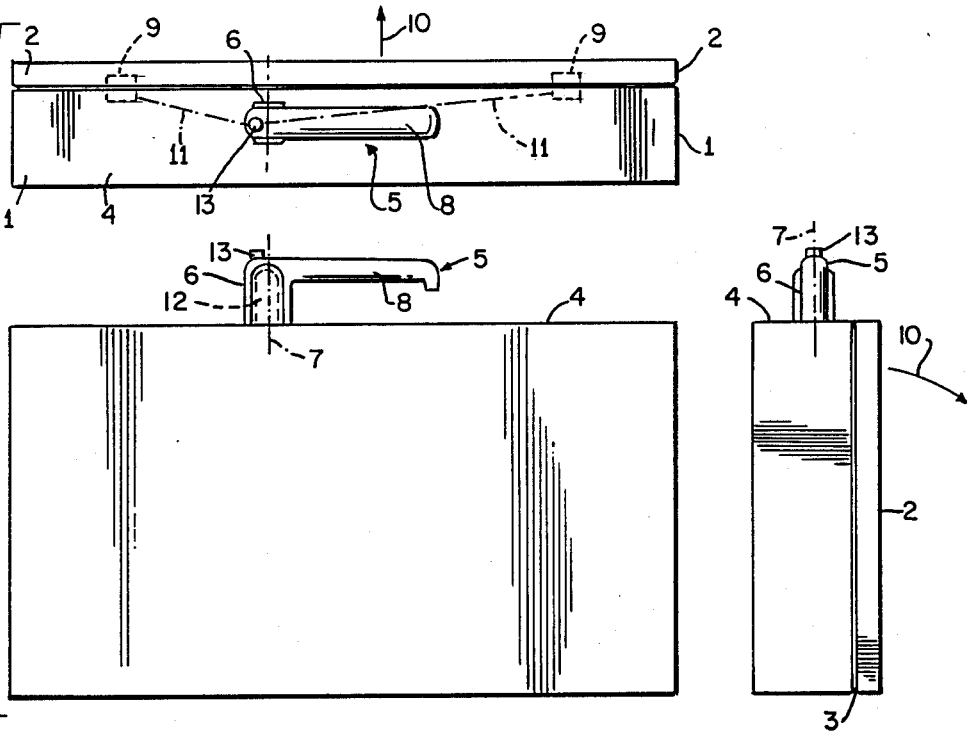
FIG. 1 shows a first embodiment of a lockable portable container according to the invention in a side view and front view as well as in a view from above.

The lockable container 1 shown in FIG. 1 is here a file case or board case, respectively, which has a top cover 2 mounted to the actual container 1 in position 3 by a not visible hinge. At the longitudinal narrow side 4 opposed to the position 3 of the hinge, a grip 5 is attached to the container for carrying the same. This grip 5 is L-shaped and pivotally attached to the container 1 via its one leg 6. The pivotal attachment is such that the grip 5 can be pivoted around the longitudinal axis 7 of the leg 6 thereby pivoting its other L-leg 8 in parallel to the longitudinal narrow side 4.

Furthermore, the lockable portable container 1 has a container locking mechanism 9 which here consists of two file case locks not visible from outside and thus only outlined in broken lines. When opening this container locking mechanism 9 the top cover 2 is released, so that it can be pivoted around the hinge being at the position 3 in the direction of the arrow 10 and the container 1 can be opened.

Furthermore, the container 1 is provided with a coupling means 11 outlined by dot-dash lines, which converts the pivotal movement of the grip 5 into a release and locking movement, respectively and/or opening and closing movement, respectively, of the container locking mechanism 9 and is therefore provided as a connection between the grip 5 and the container locking mechanism 9. There is a plurality of possible coupling means 11 which are available as mechanical elementary means to every person skilled in the art, which are in the position to transfer the pivotal movement of the grip to the container locking mechanism 9 in such a way that the container locking mechanism 9 is thereby released and locked, respectively, and/or opened and closed, respectively. It is indicated herein only as an example that a bar slidably supported in longitudinal direction is suited, among others, as the coupling means 11, one end of which bar is articulatedly attached to an arm fixedly mounted to the rotary axis of the grip 5 and the other end of which is articulatedly attached to a plate-like or tongue-like or otherwise developed release and locking element, respectively, and/or opening and closing element, respectively, as is provided for the release and locking, respectively, and/or opening and closing, respectively, of conventional case locks.

In this way, the portable container 1 which in this case is a board case as already mentioned can be closed and/or opened by simple pivoting of the grip 5 around the longitudinal axis 7 of the leg 6. This is much more practical and comfortable than to directly separately actuating the container locking mechanism 9 herein consisting of two case locks which would have to be opened or closed individually.

In order to prevent unintentional pivoting of the grip 5 around the longitudinal axis 7 and thus unintentional release and/or opening of the container locking mechanism 9, a release blocking and/or opening blocking device 12 arresting the pivotal movement of the grip 5 or neutralizing the transfer of the pivotal movement to the container locking mechanism 9 is in addition provided, which device is outlined only in broken lines, since it is arranged, for example, either in the grip or in the vicinity of the grip in the container 1 or its wall, respectively.

As already indicated, this release blocking and/or opening blocking device can be either a device arresting the grip 5 against a pivotal movement around the longitudinal axis 7 or occasionally interrupting or nullifying the active connection between the pivotal movement of the grip 5 and the coupling means 11 and/or the container locking mechanism 9. Since a plurality of possible devices are available to the person skilled in the art from the field of elementary mechanics, with which the pivotal movement of a part can be arrested or the mechanical active connection between two parts coupled to each other can be nullified or interrupted at times, it is not necessary to set forth various embodiments of the release blocking and/or opening blocking device herein. It may suffice as an example to refer to the fact that for locking the pivotal movability of the grip 5 for example a pin slidable against a spring force may be provided in the stationary part of the rotary support of the grip 5, which can engage in a radial opening in the axis of the grip 5 turnable in this rotary support thereby blocking the pivotal movement and which can be forced out of this radial recess by another pin axially slidable against the spring force inside the rotary axis so far that it releases the grip 5 for pivotal movement. A corresponding device interrupting the transfer of the pivotal movement of the grip 5 to the coupling means 11 can be developed in the coupling means given above as an example similarly as in the above means for arresting the grip 5 in that the above-mentioned lever mounted to the rotary axis of the grip 5 is not directly attached to this rotary axis but rather via a ring rotatably supported on the rotary axis, which is arrestable at and unlockable from the rotary axis of the grip 5 through a means of the above-mentioned type by first and second pins as described above.

In order to actuate the release blocking and/or opening blocking means such that the grip 5 can be pivoted or the pivotal movement is transferred to the container locking mechanism 9, a press button 13 is provided in the leg 6 of the grip 5 pivotally attached to the container 1, which can be pressed down against spring force thereby enabling a pivotal movement of the grip 5 or a transfer of the pivotal movement of the grip 5 to the container locking mechanism 9.

To give an example reference is made to the fact that the press button 13 can be arranged, for example, such that it presses down the above-mentioned second pin of the release blocking and/or opening blocking means indicated above in two examples upon actuation thereof.

Figure 2:
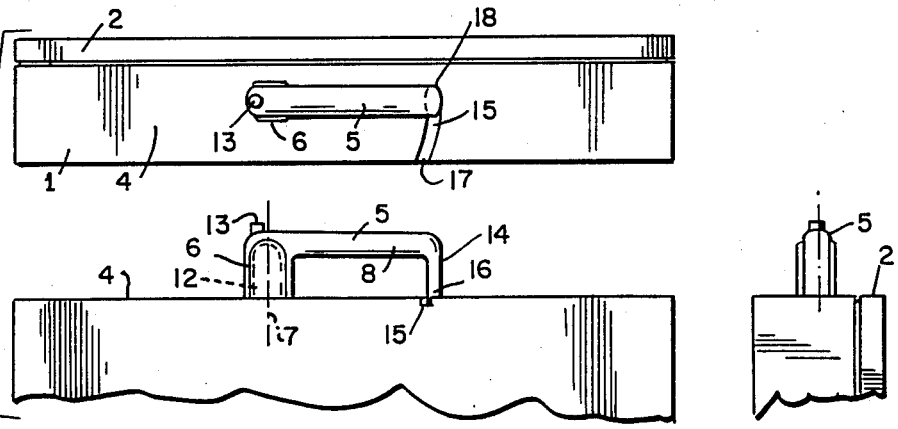
FIG. 2 shows a second embodiment of a lockable portable container according to the invention in a side view and front view as well as in a view from above.

Another embodiment of a lockable portable container illustrated in FIG. 2 essentially differs from the embodiment of FIG. 1 only in that here the grip 5 is U-shaped and is guided at the free end of the U-leg 14 thereof which is in parallel to the U-leg 6 pivotally attached to the container 1 in a guide 15 being at the container 1. This guide 15 which may be a guide groove or a guide gap for the free end 16 has two stops 17 and 18 limiting the pivotal movement of the grip 5 in both pivotal directions. These stops can be, for example, front walls of the guide 15 at the two longitudinal ends thereof.

As for the rest, regarding the description of the embodiment according to FIG. 2 reference is made to the description of the embodiment according to FIG. 1, moreover reference being made to the fact that some parts shown in FIG. 1 are not illustrated in FIG. 2 for reason of simplifying the illustration, although they are also present in the embodiment according to FIG. 2, such as especially the container locking mechanism 9 and the coupling means 11. The same applies to the embodiments of FIGS. 3 to 6, which, of course, also have a container locking mechanism 9 and a coupling means 11 as well as a release blocking and/or opening blocking device 12, even when these devices are not illustrated in particular to simplify the drawing because they were explained already on the basis of FIG. 1. Therefore, the below explanations of the embodiments according to FIGS. 3 to 6 substantially only set forth the special features over the embodiment according to FIG. 1, as for the rest, however, reference is made to the explanation of FIG. 1.

Figure 3:
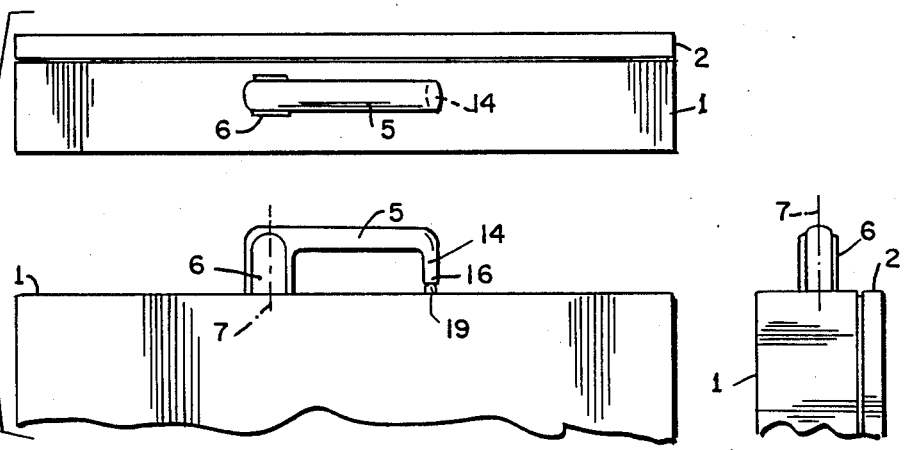
FIG. 3 shows a third embodiment of a lockable portable container according to the invention in a side view and front view as well as in a view from above, the latter view showing the grip in its arrested position.

In the embodiment according to FIGS. 3 and 4, the U-shaped grip 5 can be latched or arrested at the container 1 via a latching or arresting mechanism by means of the U-leg 14 extending in parallel to the U-leg 6 pivotally attached to the container 1, the arrow 20 in FIG. 4 indicating the pivotal movement of the grip 5, by means of which the top cover 2 is released, so that it can be raised in the direction of the arrow 10.

A ball is to be mentioned as an example of one of the many possible latching or arresting mechanisms which are available to the person skilled in the art as elementary mechanical means. This ball is pressed elastically into a recess located in the free end 16 of the U-leg 14 and can also be arrested by an appropriate means which is referred herein to as a release blocking and/or opening blocking device or corresponds to the above-mentioned release blocking and/or opening blocking device, thereby preventing unintentional pivotal movement of the grip 5. This release blocking and/or opening blocking device in turn can be actuated by a press button in such a way that the grip 5 is released for pivotal movement.

In the embodiments according to FIGS. 5 and 6 which, as already mentioned, correspond to the fundamental design of the embodiment according to FIG. 1, the press button 13 is arrestable by a combination lock 21, so that it cannot be unlocked until the combination lock 21 is actuated correspondingly and be pressed down according to the arrow 22 (see FIG. 6) to achieve a release of the grip 5 to be pivotally moved in the direction of the arrow 20. In the present preferred embodiment, the combination lock 21 is provided in the grip 5, preferably in the leg 6 thereof, which results in a compact and very clear design. As is the case in the embodiment according to FIG. 6, the combination lock can, for example, be installed laterally in the leg 6 or, as is the case in the embodiment according to FIG. 5, in the top side of the leg 6.

Any other suitable lock can of course be used instead of a combination or cylinder lock indicated in the description and the claims.

Finally, although it appears to be superfluous, reference is made to the fact that the container locking mechanism is locked again or returned to the locked position again by moving back or pivoting back the grip, unless it locks automatically by manually closing the top cover anyway as is the case in many prior art container locking mechanisms.

On the basis of FIGS. 7 to 12 a container locking mechanism 9, a coupling means 11 and a release blocking and/or opening blocking device is according to a preferred embodiment of the invention are now set forth, which may be installed in one of the containers according to FIGS. 1 to 6, especially in one of the containers according to FIGS. 1, 5 and 6.

In the beginning, the release blocking and/or opening blocking device 12 is set forth mainly on the basis of FIG. 7.

It comprises the press button 13 provided at the one end of a lever arm 22 whose other end is pivotally supported inside the grip 5 around the axis 23 extending vertically to the drawing plane.

The upper end 24 of the axis 25 of a combination lock 21 is provided in the pivotal path of the lever arm 22. This end 24 is forced upwardly against the lever arm 22 by means of a compression spring 26 inserted between this enlarged end 24 and the other part of the combination lock 21. The present combination lock 21 comprises three number wheels 27*a*, 27*b* and 27*c* as well as appropriate cam wheels 28*a*, 28*b* and 28*c*. However, it can also comprise two number wheels as outlined in FIG. 6, or three or more number wheels. Moreover, symbols other than numbers can be provided on the number wheels. This combination lock 21 is constructed in known manner such that its axis 25 is slidable downwardly in is longitudinal direction against the force of the compression spring 26 only when the number or symbol combination opening the combination lock is adjusted by means of the number wheels 27*a*, 27*b* and 27*c*. When this is the case, the lever arm 22 can be pivoted downwardly around its axis 23 by a downward pressure onto the press button 13.

Furthermore, the upper end 29 of a locking pin 30 is in the pivotal path of the lever arm 22, and this enlarged end 29 is pressed against the bottom side of the lever arm 22 by means of a recuperating spring 31. The locking pin 30 is downwardly slidable in its longitudinal direction, in the present case in parallel to the axis 25 of the combination lock 21, and this downward shift of the locking pin 30 is effected by pressure onto the press button 13 by means of the lever arm 22 when its pivotal movement is released by the combination lock 21. The lower end 32 of the blocking pin 30 engages in a circular opening 33 when being in the locking position, i.e. in the position in which the grip 5 cannot be turned round the axis 7, which opening is provided in a guide and support plate 34 (see FIG. 9) which, in turn, is fixedly mounted in the longitudinal narrow side 4 of the container 1. A circumferential groove 35 of the locking pin 30 lies upwardly contiguous to the lower end 32. When the locking pin 30 is displaced downwardly by pivoting the lever arm 22, this circumferential groove 35 extends into the upper region of the opening 33, which changes into a constricted arc-shaped guiding way 36, the width of which is somewhat greater than the diameter of the locking pin 30 in the region of the circumferential groove 35 but smaller than the diameter of the locking pin in the region of the lower end 32. Therefore, when the circumferential groove 35 extends into the upper region of the opening 33 and thus into the region of the guide groove 35, the lower end of the locking pin 30 can move along the guiding way 36, i.e. the grip 5 can be pivoted around the axis 7 at an angle corresponding to the arc length of the guiding way 36. Reference is also made to the fact that the opening 33 also has a lower region changing into a broader guiding way 37 for the end 32, which extends in parallel to the guiding way 36.

The guide and support plate 34 also has a bearing sleeve 38 in which a pivot pin 39 is supported rotatably, which, in turn, is fixedly provided in the grip 5. A threaded sleeve 40 into which a long screw 41 is screwed from above and a short screw 42 is screwed from below extends coaxially with respect to the longitudinal axis 7 through this pivot pin 39, a bolt 44 being mounted to the lower end of the pivot pin 39 by means of the short screw 42 and a washer 43. As FIG. 10 shows, the bolt 44 is generally annular and has two inner projections 45 and two outer projections 46*a* and 46*b*. The inner projections 45 engage in two grooves provided at the lower end of the pivot pin 39, thereby fixedly connecting the bolt 44 to the pivot pin 39. Since the pivot pin 39, in turn, is fixedly inserted in the grip 5, the bolt 44 illustrated in FIG. 10 from above is turned as well when the grip 5 is turned around the longitudinal axis.

As can be seen from FIG. 8, the bolt 44 already forms part of the coupling means 11 by which the rotary movement of the grip 5 is transferred to the container locking mechanism 9. One longitudinal end 47*a* and 47*b* of a sliding bar 48*a* and 48*b* each is located in the region of rotation of each of the two outer projections 46*a* and 46*b*. These two sliding bars 48*a* and 48*b* are longitudiunally slidably supported in the groove-formed guide 49 of an assembly guide 50 which, in turn, is provided fixedly inside the longitudinal narrow side 4 in such a way that its longitudinal direction extends in the longitudinal direction of this longitudinal narrow side 4. When turning the grip 5 in the position shown in the upper part of FIG. 6, the projection 46*a* presses onto the longitudinal end 47*a* and displaces the sliding bar 48*a*, based on the view of FIG. 8, towards the left, while the projection 46*b* simultaneously presses onto the longitudinal end 47*b* and forces the sliding bar 48*b* against the spring force of the recuperating spring 51 towards the right. As a result, the longitudinal end 52 of the sliding bar 48*b* opposed to the longitudinal end 47*b* actuates the container locking mechanism 9 on the right-hand side of the container 1—based on FIG. 8—while a corresponding container locking mechanism 9 on the left-hand side of the container 1 is simultaneously actuated by the corresponding longitudinal end of the sliding bar 48*a*, a recuperating spring being provided for the sliding bar 48*a* in the region of this longitudinal end, which corresponds to the recuperating spring 51.

The container locking mechanism on the right-hand side of FIG. 8 is illustrated in its closed state, whereas it is shown in its open state on the left-hand side of FIG. 8.

The container locking mechanism 9 now detailed on the basis of FIG. 8 substantially consists of a slide plate 53, a spring 54 which is U-shaped in the present example, an ejector 55 and a locking hook 56, the first three parts of which are provided at the interior of the longitudinal narrow side 4 of the container 1, whereas the locking hook 56 is provided at the top cover 2.

The slide plate 53 is longitudinally slidably supported in a groove-shaped guide 57 (see FIG. 11) of the assembly guide 50 and has a locking projection 58 extending vertically to the drawing plane of FIG. 8, which projection engages in the opening 59 of the hook 56 and can be moved out of this opening 59 by displacing the slide plate 53, based on FIG. 8, towards the right, thereby releasing the top cover 2 for opening.

Moreover, a release projection 60 going beyond the drawing plane of FIG. 8 is provided at the right end of the slide plate, and a stop projection 61 also going beyond the drawing plane and an engagement projection 62 directed towards the left are provided at the left end thereof. The engagement projection 62 engages in the recess 63 in which the recuperating spring 51 is located; the functioning of the two other projections 60 and 61 is explained below.

The ejector 55 is rotatably supported around an axis 64 stationary relative to the assembly guide 50 fixedly attached to the longitudinal narrow side 4 of the container 1. One side 65 of this ejector 55 is adjacent to the free end of the hook 56 and is exposed to an initial tension by means of the spring 54, which endeavors to turn the ejector 55 in the direction towards the hook 56, i.e. clockwise in FIG. 8. In the locking position of the container locking mechanism 9 shown in FIG. 8, however, the ejector 55 is prevented from rotating in that a nose 66 provided thereat engages with the release projection 60 of the slide plate 53. It is to be additionally mentioned that the spring 54, which, on one side thereof, exposes pressure to the ejector 55 in the direction of the rotary motion mentioned, is supported on the other side thereof at the stop projection 61. On its other side the stop projection 61 is adjacent to the longitudinal end 52 of the sliding bar **48*b***.

The actuation of the container locking mechanism 9 of FIG. 8 functions as follows:

When the sliding bar **48*b* is displaced out of the position shown in FIG. 8 by turning the bolt 44 against the force of the recuperating spring 51 to the right, it also moves the slide plate 53 to the right. During this sliding movement the spring 54 is initially tensioned, since the release projection 60 initially remains in engagement with the nose 66. Towards the end of this sliding movement the locking projection 58 comes completely out of the opening 59, and the release projection 60 disengages with the nose 66 as well. The ejector 55 is thereby released for turning movement effected by the tensioned spring 54. As a result, its side 65 forces the hook 56, based on FIG. 8, downwards, which means that the top cover 2 of the container 1 opens because the hook 56 is located at the top cover 2** as already mentioned.

In this opened state of the container 1, the grip 5 can be pivoted again in its neutral position in which it can be locked by means of the locking pin 30. During this repivoting, the sliding bars **48*a* and 48*b* are moved again in the position shown in FIG. 8 by means of their recuperating springs, such as the recuperating spring 51 for the sliding bar 48*b*. However, the slide plate 53 cannot follow this movement because it is prevented from moving to the left (based on the view of FIG. 8) by the side 67 of the nose 66 directed towards the right, which engages with the side 68 of the release projection 60 directed towards the left. Only when the hook 56 is moved again into the position shown in FIG. 8 by closing the top cover 2 is the ejector turned upwards or counterclockwise by the free end of the hook 56, which presses onto the side 65 of the ejector 55, so that now the slide plate 53 moves towards the left into the position shown in FIG. 8 on account of the spring force of the spring 54. As a result, the locking projection 58 enters the opening 59 of the hook 56, thereby locking the top cover 2** in the closing position.

The above-described possibility, i.e. being able to pivot the grip 5 in its neutral position again without having to lock the container 1, is particularly of advantage because the user can turn the number wheels **27*a*, 27*b* and 27*c* immediately after opening, so that no unauthorized person can see the number or symbol combination required for opening while the container 1** is open.

When the combination lock 21 is in its open position and the press button 13 is pressed down, the number or symbol combination required for opening the combination lock 21 can be changed by turning the number wheels **27*a*, 27*b* and 27*c***.

Finally it is to be mentioned that the grip described can also be used as a door handle, window handle, etc.

I claim:

1. A lockable portable container of the suitcase, brief case, file case variety having:

locking and latching means mounted in the container, for holding a cover of the container fixedly abutting and secured to a body of the container;

a single carrying grip means for lifting and toting of the container;

said single grip means being pivotally mounted with respect to the container and connected to the locking and latching means;

pivotal movement of said grip means from a first position causing both unlocking and then separation of the locking and latching means with respect to the body of the container by first unlocking the locking and latch means and then by spacing an edge of the cover from the body of the container by the locking and latch means;

means for locking pivotal movement of the single grip means, including actuating means therefor; and wherein said actuating means is carried by said single grip means.

2. The lockable portable container according to claim 1, wherein the actuation element comprises a press button (13) and a cylinder or combination lock (21).

3. The lockable portable container according to claim 1, wherein the actuation element is a press button (13) arrestable by a cylinder or combination lock (21).

4. The lockable portable container according to claim 2, wherein the cylinder or combination lock (21) and the press button (13) are provided at the single grip means (5).

5. The lockable portable container according to claim 2, wherein the press button (13) is provided at a pivotally supported lever arm (22), the pivotal movement of which is arrestable by the cylinder or combination lock (21) and which acts upon a locking pin (30) cooperating with a locking and guide means mounted at the container (1).

6. The lockable portable container according to claim 2, wherein the container locking and latching means (9)

has a plate (53) slidable by the coupling means (11), and which cooperates with an ejector means (55) that is both pivotal around an axis (64) stationary with respect to the container (1) and is biased by a compression spring (54) in the sense of being provided for the hook (56) at the slide plate (53) and the slide plate in addition having a release projection (60) for the ejector (55), which secures the ejector (55) in a locking position of the container against pivotal movement and which secures the slide plate (53) in a release position of the container against sliding into the locking position.

7. The lockable portable container according to claim 1, wherein the single grip means (5) has at least two legs (6, 8, 14) and one leg (6) thereof is pivotally mounted to the container (1).

8. The lockable portable container according to claim 1, wherein the single grip means (5) is mounted to the container (1) pivotally around a longitudinal axis (7) of said one leg (6).

9. The lockable portable container according to claim 1, wherein the single grip means (5) is L-shaped or U-shaped and mounted to the container (1) pivotally around a longitudinal axis (7) of one of the L-legs or U-legs.

10. The lockable portable container according to claim 9, wherein the U-shaped single grip means (5) is U-shaped and the means for locking pivotal movement of the U-shaped single grip means operates on the other U-leg (14) extending in parallel to the U-leg (6) pivotally mounted to the container (1).

11. The lockable portable container according to claim 10, wherein the other U-leg has a free end (16) guided in a guide (15) at the container (1) and which has stop means (17, 18) for limiting the pivotal movement of the single grip means (5).

12. The lockable portable container according to claim 1, wherein the locking means is a detachable movement lock for the single grip means (5).

13. The lockable portable container according to claim 12 wherein the movement lock (12, 19) can be released and unlocked, respectively, by means of an actuation element (13).

14. The lockable portable container according to claim 13, wherein the actuation element (13) is provided at the single grip means (15).

15. The lockable portable container according to claim 13, wherein the actuation element comprises a press button (13) and a cylinder or combination lock (21).

16. The lockable portable container according to claim 15, wherein the actuation element is a press button (13) arrestable by a cylinder or combination lock (21).

17. The lockable portable container according to claim 15, wherein the cylinder or combination lock (21) and the press button (13) are provided at the single grip means (5).

18. The lockable portable container according to claim 15, wherein the press button (13) is provided at a pivotally supported lever arm (22), the pivotal movement of which is arrestable by the cylinder or combination lock (21) and which acts upon a locking pin (30) cooperating with a locking and guide means mounted at the container (1).

19. The lockable portable container according to claim 2, wherein the connection between the single grip means and the locking and latching means includes a coupling means (11) that comprises a bolt (44) unpivotally mounted to the single grip means (5) and sliding bar means movable by the rotation of the single grip means for actuating the container locking mechanism (9).

20. The lockable portable container according to claim 19, wherein the container locking and latching means (9) has a plate (53) slidable by the coupling means (11), and which cooperates with an ejector means (55) that is both pivotal around an axis (64) stationary with respect to the container (1) and is biased by a compression spring (54) in the sense of pushing away a hook (56) mounted to the top cover (2) from the body container (1), a locking being provided for the hook (56) at the slide plate (53) and the slide plate in addition having a release projection (600 for the ejector (55), which secures the ejector (55) in a locking position of the container against pivotal movement and which secures the slide plate (53) in a release position of the container against sliding into the locking position.

* * * * *